United States Patent [19]

Grunwald et al.

[11] Patent Number: 5,072,148

[45] Date of Patent: Dec. 10, 1991

[54] DISPENSER CATHODE WITH EMITTING SURFACE PARALLEL TO ION FLOW AND USE IN THYRATRONS

[75] Inventors: Henry C. Grunwald; Murray J. Kennedy, both of Bethlehem, Pa.

[73] Assignee: ITT Corporation, New York, N.Y.

[21] Appl. No.: 596,957

[22] Filed: Oct. 15, 1990

[51] Int. Cl.[5] ..... H01J 1/28

[52] U.S. Cl. ..... 313/346 DC

[58] Field of Search ..... 313/346 R, 346 DC

[56] References Cited

U.S. PATENT DOCUMENTS 2,858,470 10/1958 Thurber ..... 313/346 DC

*Primary Examiner*—Sandra L. O'Shea

*Attorney, Agent, or Firm*—Arthur L. Plevy; Patrick M. Hogan; Peter A. Abruzzese

[57] ABSTRACT

A dispenser cathode is designed with an emitting surface including at least one emitting groove characterized by steep opposing walls oriented parallel to the ion flow wherein the walls have a given depth and are separated from each other by a given distance such that bombarding ions which impinge on one wall cause emitting material depleted therefrom to be deposited on the opposite wall. The cathode design, particularly the groove area, width and depth, are selected to optimize its emission current density, operational characteristics, and lifetime. Since the grooved dispenser cathode eliminates the effects of ion bombardment without sacrificing performance, the improved dispenser cathode can be used in thyratons and other gas filled electron tubes to provide an order of magnitude improvement in performance over standard cathodes.

20 Claims, 8 Drawing Sheets

DISPENSER CATHODE WITH EMITTING SURFACE PARALLEL TO ION FLOW AND USE IN THYRATRONS

FIELD OF INVENTION

This application is related to U.S. patent application Ser. No. 07/502078, filed Mar. 29, 1990, by H. C. Grunwald, entitled "Dispenser Cathode With Emitting Surface Parallel To Ion Flow".

This to dispenser cathodes for use in diffuse discharge gas tubes, and more particularly, to a dispenser cathode which employs an emitting surface parallel to ion flow and its use in thyratrons.

BACKGROUND OF INVENTION

Dispenser cathodes have been employed for a number of years in devices requiring control of an electron emission current. Generally, they are made of a strongly-bonded, continuous metallic phase, refractory metal or metals, interspersed uniformly with an electron-emitting material. The porous metal matrix acts as a reservoir from which the emitting material can diffuse to the emitting surface, maintain an active layer and consequently provide a low work-function surface for the thermionic emission of electrons. This definition excludes oxide-coated cathodes, pure metal emitters, and thoriated tungsten.

Currently, the majority of dispenser cathodes are used in devices such as cross-field amplifiers, klystons, magnetrons, travelling-wave tubes, backward-wave oscillators, cathode ray tubes, and gas-ion lasers. Other applications include electronbombarded semiconductor (EBS) devices and X-ray tubes. The design and fabrication of cathodes is determined by such factors as the environment of operation, the required emission current density, the temperature of stable operation, and the device life requirements. Obtaining reliable electron current over a long period of use is a function of the equlibrium established between the rate of arrival of the emitting material (barium) at the emitting surface and its rate of evaporation from the emitting surface.

Preferred dispenser cathodes employ a porous tungsten structure impregnated with a mixture of barium oxide and other compounds which enhance emission and lower the work function. The barium emitting material is produced in the pores of the tungsten matrix by reaction of the impregnant and the tungsten. Equilibrium established at the cathode surface supports only a monolayer or less of barium on the surf pores near the surface are depleted of barium due to the decrease of barium migration with time, and the monolayer becomes a partial monolayer. At the end of the cathode life, when the rate of barium arrival supports only a partial monolayer, the effective work function is too high to sustain the required emission and the cathode fails.

There are many factors which influence the performance of dispenser cathodes. One of the most important influences on evaporation and emission properties is the missive mix or impregnant composition. Materials which have been used are alkaline earth-metal silicates, aluminates, thorates, berylliates, borates, tungstates, and scandates. Of these materials, barium and calcium aluminates have been used extensively. Recent attention has been given to scandates and tungstates. The matrix pore size, density, and uniformity influence the emission current capability of the dispenser cathode. The composition and density of the matrix structure can be varied, e.g. from 75% to 85% of theoretical weight by volume. Protective or hardening materials may also be applied in a thin layer coating on or combined into the matrix of the cathode. A more complete review of modern dispenser cathodes is given in an article entitled "Modern Dispenser Cathodes" by J. L. Cronin, published in I.E.E.E. Proceedings, Volume 128, Part 1, No. 1, February 1981, pages 19–32.

Conventional dispenser cathodes provide emission current densitities in the range of several amperes per square centimeter, at operating temperatures below 1100 degrees Centigrade, for an operational life of several thousands of hours. It is desirable to improve the performance of dispenser cathodes to deliver emission current densities in the range of a hundred to several hundred amperes per square centimeter, for life times in excess of 50,000 hours.

It is also desirable to extend the cathode operational capability/scope to include high power thyratrons. Thyratrons, as opposed to travelling wave tubes, are gas-filled devices. When electrons are emitted from the cathode of a thyratron, they collide with the gas molecules and ionize the gas. The positive ions are then accelerated by the electric field and bombard the cathode surface. The ion bombardment can have a detrimental effect on the operating characteristics of the tungsten impregnated cathode, by depleting the cathode surface of emitting material, thus reducing the life of the cathode. Thus, tungsten impregnated dispenser cathodes are not commonly used in thyratrons as primary emitters.

The hydrogen thyratron is the preeminent switching device utilized in high energy machines requiring precise interpulse timing, such as radars, accelerators, isotope separation, photochemistry laser systems and, more recently, directed energy systems. The development of super power thyratrons requires an increase in four switch-limited parameters: repetition rate; rate of rise of current and (di/dt); peak and average power capabilities; and switch lifetime. Of these, the first factor is principally limited by the deionization time of the thyratron plasma and is partially cathode dependent. The latter three factors are dependent on the design of the cathode and its emission current characteristics.

SUMMARY OF INVENTION

It is therefore a principal object of the invention to provide an improved dispenser cathode which minimizes the effects of ion bombardment and can be operated at high current densities for a long lifetime. It is further object to employ a dispenser cathode in a thyratron, particularly a high power hydrogen thyratron, in order to improve its switching and peak power performance characteristics.

In accordance with the invention, a dispenser cathode is designed with an emitting surface including at least one emitting groove characterized by steep opposing walls oriented parallel to the ion flow wherein the walls have a given depth and are separated from each other by a given distance such that the adverse effects of ion bombardment will be minimized, while concurrently maximizing emission capability. The ratio of separation distance to depth and its operational parameters are selected to optimize the current density and operational life of the improved dispenser cathode.

The improved dispenser cathode can be operated at peak current densities of 150 Amps/cm$^2$ for long lifetimes at least comparable to those of conventional cathodes operated at lower current densities. It greatly reduces the effect of ion bombardment on the cathode surface, and therefore can extend the lifetime of the dispenser cathode.

The invention also encompasses the use of the improved dispenser cathode in thyratrons. Since the design of the improved dispenser cathode eliminates the effects of ion bombardment without sacrificing performance, the standard oxide-coated and impregnated mesh cathodes currently used in thyratrons can be replaced by the improved dispenser cathode. The operation of the improved dispenser cathode in thyratrons can be optimized to have a current density, a rate of rise of current, and a peak switching power an order of magnitude greater than the conventional oxide-coated cathode.

BRIEF DESCRIPTION OF DRAWINGS

The above objects and further features and advantages of the invention are described in detail below in conjunction with the drawings, of which.

DETAILED DESCRIPTION OF INVENTION

Figure 1:
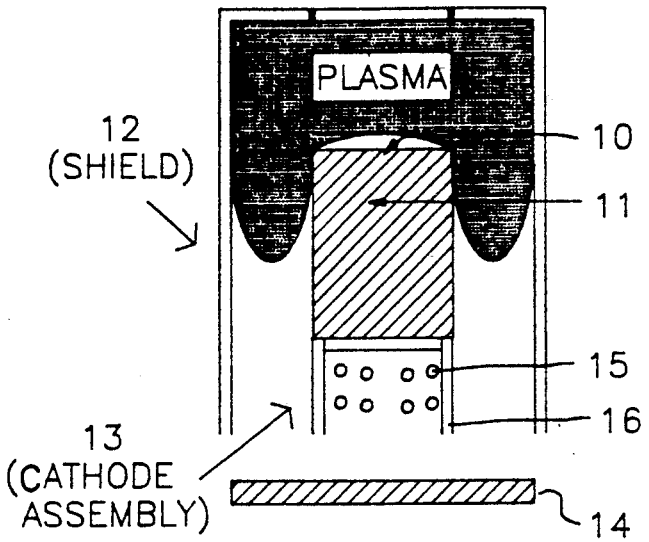
FIG. 1 is a schematic depiction of a conventional dispenser cathode in a gas-filled device.

Referring to FIG. 1, a conventional dispenser cathode assembly 13 has a generally cylindrical emitter portion 10 with a horizontal upper surface and an interior reservoir 11 containing the emitting material. The cathode is formed from a porous matrix of refractory metal, e.g. tungsten, and the emitting material is typically barium oxide and other compounds. The emitting material may be contained in a cavity, from which it is drawn into the porous tungsten matrix, or may be uniformly impregnated therein. Potted heater coils 15 are disposed below the emitter portion 10. The cathode may also be directly heated. The cathode 10,11 is supported on a base 14 and mounted to support walls 16 typically made of a non-reactive, heat-resistant material such as molybdenum.

If the cathode 13 is used in a gas-filled device, such as a laser or a thyratron, a plasma region (shaded area) is formed around the cathode. Positive ions created in the plasma region are accelerated by the electric field between the cathode and a corresponding anode and bombard the cathode surface. The ion bombardment can have a detrimental effect on the cathode by depleting the cathode surface of emitting material and reducing the life of the cathode. Thus, conventional dispenser cathodes are not extensively used in thyratrons as primary emitters.

It has also been found that not all areas of the cathode are utilized in the emission cycle. The effective area of the cathode can be defined as the area at which the cathodeplasma interface occurs. The effective cathode area is dependent upon the cathode geometry and the propagation rate of the plasma wave along the cathode surface. The conventional dispenser cathode shown in FIG. 1 has an effective area of only about 50% of the physical surface area of the cathode.

Figure 2A:
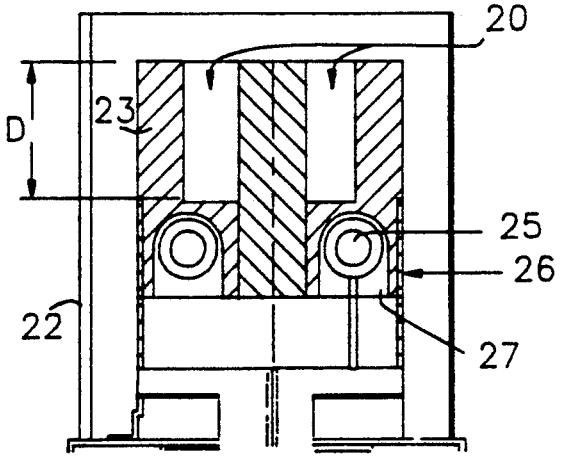
FIGS. 2A and 2B are side and top cross-sectional views of a grooved dispenser cathode in accordance with the invention.
Figure 2B:
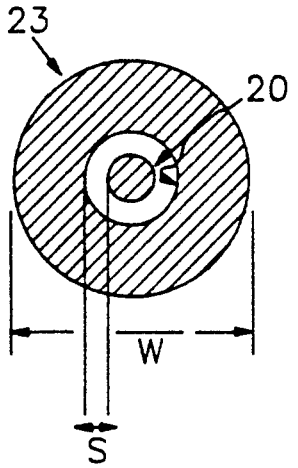

An improved dispenser cathode in accordance with the invention is illustrated in side cross-sectional view in FIG. 2A and top view in FIG. 2B. The dispenser cathode 23 has at least one emitting groove 20 characterized by steep opposing walls oriented parallel to the ion flow wherein the walls have a given depth D and are separated from each other by a given distance S.

For simplicity, the cathode is shown as having a right cylindrical shape and one annular groove concentric with its cylinder axis. Further examples, given below, illustrate other geometries wherein multiple grooves or rings are used. The cathode has an overall width or diameter W. Heater coils which may be potted, 25, support walls 26, and thermal isolation holes are disposed in the base portion of the cathode.

Since the groove geometry allows recovery of emitting material evaporated from the respective walls due to ion bombardment, minimal net loss of emitting material and thermal energy occurs. In accordance with the invention, the groove(s) or ring(s) defined by separated, opposing walls oriented parallel to the ion flow eliminates the detrimental effects of ion bombardment without sacrificing the advantageous performance characteristics of the dispenser cathode. The spacing S and depth D of the cathode groove(s) are chosen so that the propagation of the plasma wave into the groove(s) is sufficient to meet the current rise time requirements for the cathode. The interpenetration of the plasma wave into the groove(s) results in the effective area of the cathode being about equal to or greater than the external physical surface area of the cathode block, thereby allowing for an increase in average peak current density and switching characteristics.

In accordance with a further aspect of the invention, the dispenser cathode is used in a gas-filled thyratron to increase the operational and switching characteristics of the thyratron by an order of magnitude over conventional thyratrons using oxide-coated or impregnated mesh cathodes. The latter cathodes are typically limited to current densities of the order of 30 Amps/cm$^2$. Although conventional tungsten impregnated cathodes are capable of emitting in the range of 150 Amps/cm$^2$, they have not commonly been used in thyratrons. The problem of ion bombardment causes the current density output of the cathode to decrease markedly over a relatively short time and the service lifetime to be shortened. By using the grooved tungsten impregnated cathode of the invention in a thyratron, the current densities and high speed switching characteristics of such cathodes can be realized in a thyratron.

An overall review of fabrication techniques and design factors for conventional tungsten impregnated cathodes is provided in the article "Modern Dispenser Cathodes" by J. L. Cronin IEE Proceedings Vol. 128 Pt. 1, No. 1, February 1981. The grooved tungsten impregnated cathode of this invention is preferably fabricated from an 80% density porous tungsten block structure impregnated with emitting material of the mole ratio $5BaO:3CaO:2Al_2O_3$. Reference is made to the copending U.S. patent application Ser. No. 07/502,078 for a further explanation of the fabrication of the tungsten impregnated cathode.

Some of the more important design factors applicable to the grooved tungsten impregnated cathode of the invention are discussed hereinbelow with respect to use in a hydrogen thyratron, and its operational characteristics are compared to those of the conventional oxide-coated cathodes used in hydrogen thyratrons.

Figure 3:
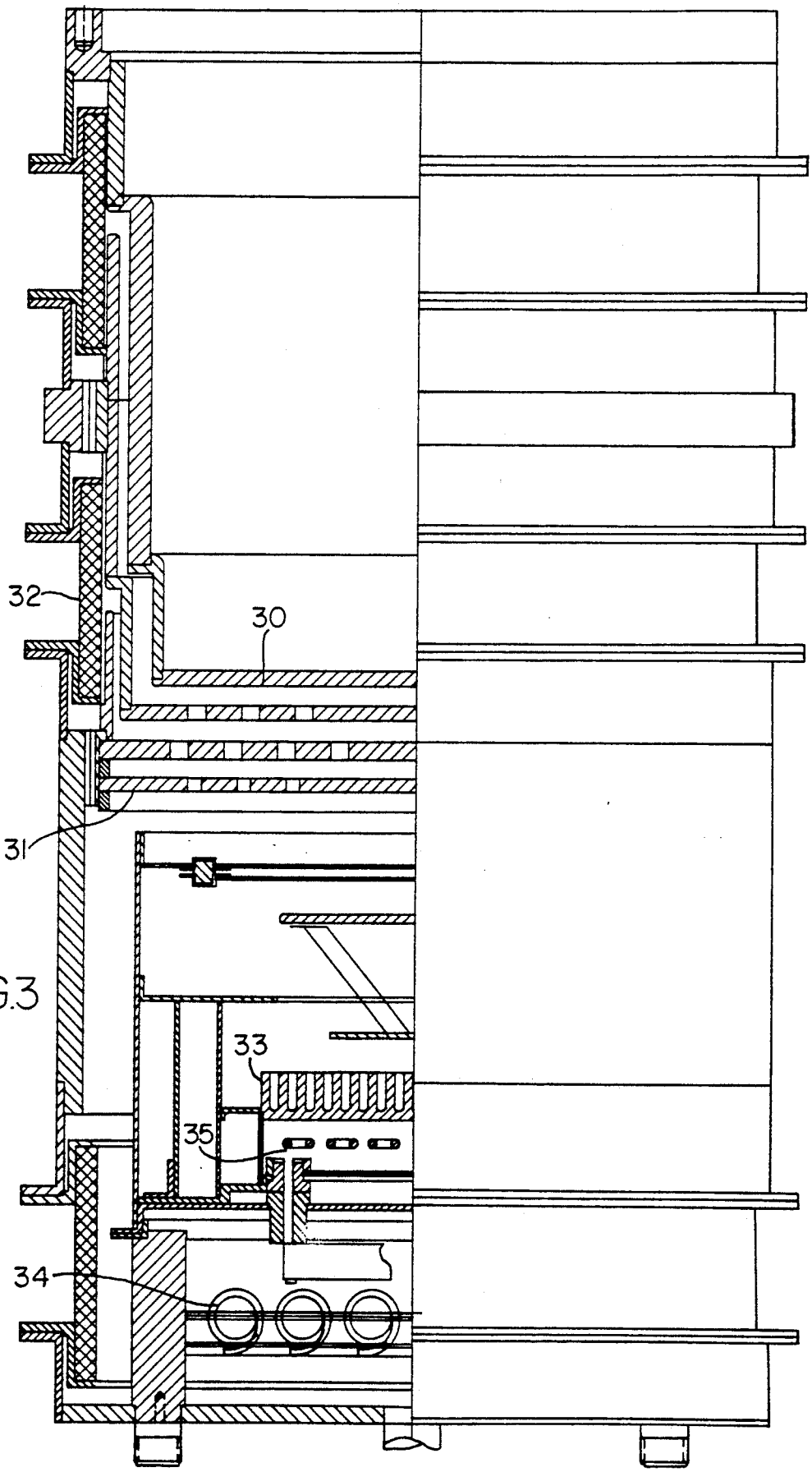
FIG. 3 is a schematic view of a multi-vaned version of the grooved dispenser cathode as used in a hydrogen thyratron in accordance with the invention.

In FIG. 3, the side cross-sectional view of a thyratron shows the major components of the thyratron, i.e. anode 30, grid 31, and cathode 33 encased in a ceramic envelope 32 which is filled with hydrogen. The cathode is shown as having multiple vanes, wherein each adjacent pair has the opposing vertical walls parallel to the direction of ion flow that minimizes the effect of ion bombardment. When the thyratron conducts, the hydrogen gas is ionized and a plasma is created which leads to elimination of space charge effects. Hydrogen thyratrons are typically equipped with a titanium hydride reservoir 34 which absorbs hydrogen and releases it during heating of the thyratron in order to maintain the desired gas pressure in the tube. The cathode 33 is heated to operating temperature via application of AC or DC voltage to the heater coil 35. After a specified warm-up time, a field voltage may be applied from anode to cathode. The thyratron as a switch will remain in a Hold-Off state until a trigger voltage is applied to the grid 31, whereupon the thyratron begins to conduct. The Hold-Off state is restored after the current through the tube has dropped to zero.

Figure 4:
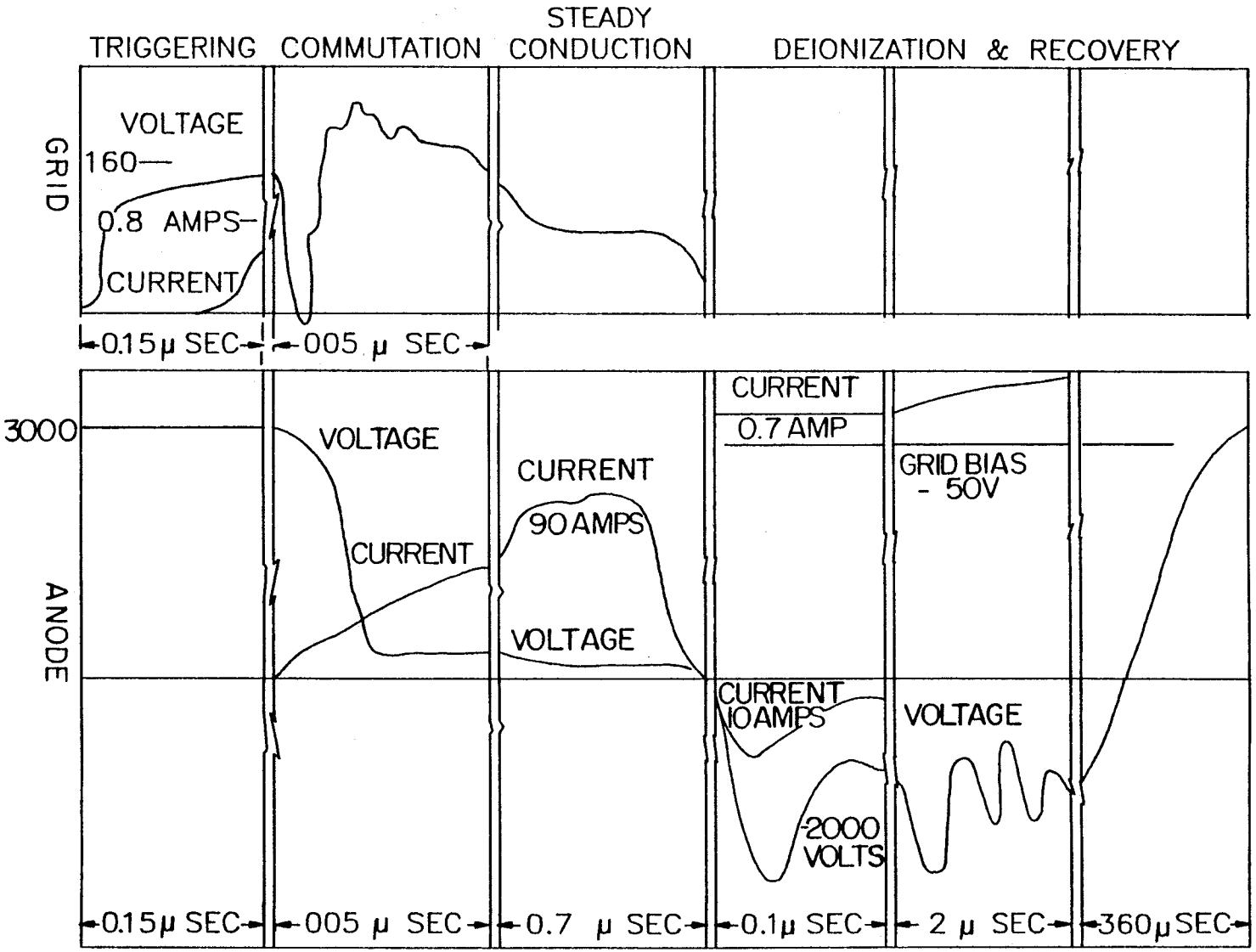
FIG. 4 PRIOR ART
FIG. 4 is a depiction of the phases of the switching cycle of a thyratron.

The switching cycle of the thyratron is illustrated in FIG. 4 (prior art) as divided into four phases. Proper operation of the thyratron is dependent on cathode geometry as it affects each phase of the cycle. The switching events in the operation of the thyratron are triggering, commutation, steady conduction, and deionization and recovery. In the triggering phase, a trigger voltage is applied to the grid, and the initial current drawn to the grid is determined to grid spacing, cathode geometry and trigger circuit characteristics. In order to trigger the tube, which involves ionizing the grid-cathode space, a given grid current must be drawn, the amplitude of which is dependent upon the gas type and pressure. The geometry of the cathode must be such that the current necessary to enter into a glow discharge state can be drawn when the trigger voltage is applied.

Figure 5A:
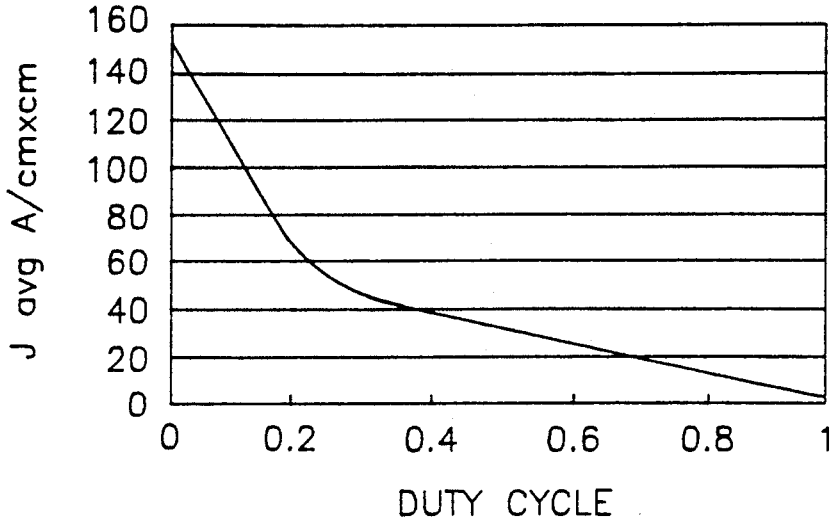
FIG. 5A is a representative plot of the relationship of average current density to duty cycle for the thyratron.
Figure 5B:
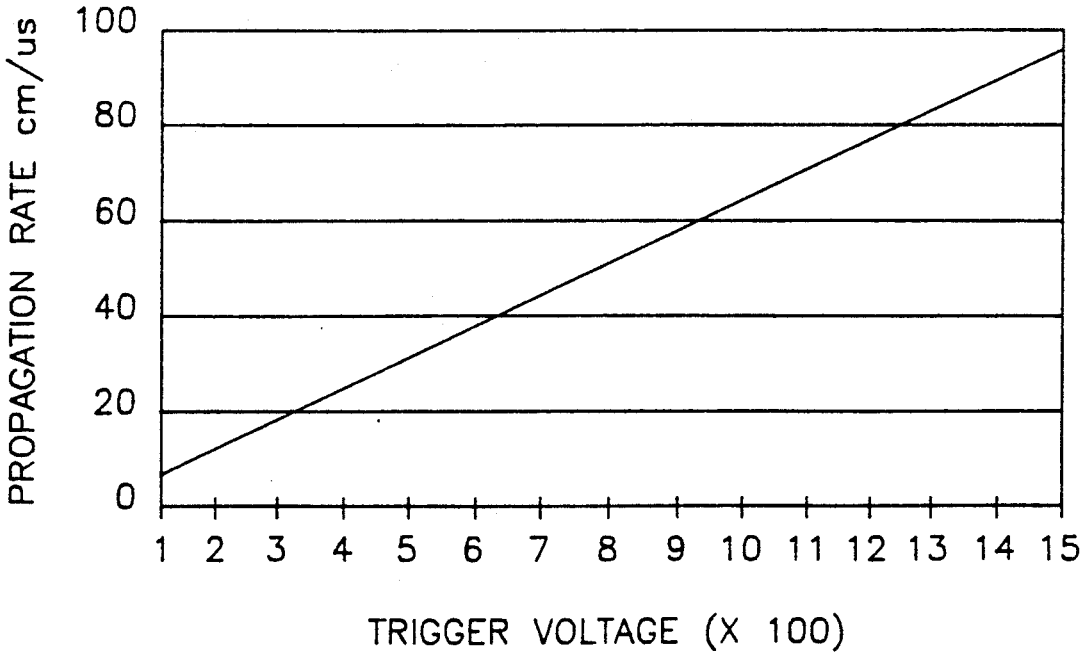
FIG. 5B illustrates the relationship of plasma propagation rate to trigger (grid) voltage for the thyratron.

Once the grid current necessary to initiate a glow discharge has been drawn from the cathode, a plasma begins to form in the grid-cathode space during the commutation phase. The electrons drawn to the grid are accelerated in the anode field which results in ionizing collisions in the anode-grid space. Since the anode-grid space is not fully ionized, the ions are accelerated into the grid-cathode space by the anode potential. This process leads to the development of the grid-cathode plasma which develops at the grid and spreads toward the cathode at a rate governed by ambipolar diffusion. Useful studies of the propogation rates of the plasma front from the grid to the cathode were measured by Goldberg and Rothstein in 1962 for a range of trigger voltages. As illustrated in FIG. 5B the propagation rate of the plasma front was found to be dependent upon the applied grid potential. The maximum rate of rise of current (di/dt) for a give geometry and trigger voltage can be calculated if the peak current density J(avg) and propagation rate of the plasma wave along the cathode surface is known. If the calculated di/dt is less than the desired rise time, the grid drive voltage or the cathode geometry can be adjusted to meet the required operating parameters.

The geometry of the cathode has its greatest effect on performance during conduction. The baseline dimensions of the cathode are selected in accordance with the conduction phase requirements of peak current and duty cycle. The de-ionization and recovery time of the device is dependent upon the gas pressure and thyratron geometry, and is not as dependent on cathode geometry.

The peak current density that a cathode is capable of operating at is determined by the desired operational duty cycle. A plot of current density versus duty cycle for a conventional Type-B cathode is shown in FIG. 5A. The grooved tungsten impregnated cathode of the invention has a comparable performance characteristic. Given the desired duty cycle, the maximum current density J(avg) of the cathode can be determined from the graph.

Once the maximum average current density J(avg) is selected, a determination of the required voltage drop across the device can be made. It is found that the voltage drop $V_d$ across the device can be calculated by the following equation:

$$V_d = V_s + RA_s J(avg), \quad (1)$$

where $V_s$ is the sustatining voltage of typically 100 Volts, and the product of $RA_s$ is a constant equal to 0.833 ohms-cm$^2$.

It is found that the depth D of the cathode groove can be calculated by the following equation:

$$D = 2(J(avg) - J_o)/s(dE/dZ), \quad (2)$$

where $J_o$ is the value of current density at the bottom of the cathode depth taken to be in the range of between 75% and 95% of J(avg), and preferably about 85% of J(avg), s is the average value of the conductivity of the plasma sheath, and dE/dZ is the rate of change of field intensity with respect to distance Z, taken to be a constant value of 2.5 KV/cm$^2$. It is found that if $J_o$ is chosen to be less than 75% of J(avg), the length of the cathode may be unsuitable for most thyratron applications. If a value of greater than 95% of J(avg) is used, the cathode may be susceptible to ion bombardment. The variation of current density with distance is taken to be a linear function.

For tests conducted on the single-groove cathodes, it is found that the width of the groove, which can be expressed as $W=(OD-ID)/2$, should be at least 20 times the plasma sheath width $L_s$. When groove widths of less than $20L_s$ are used, the gas in the groove will not ionize, and the cathode will not emit in the prescribed fashion. The maximum sheath width $L_s$ of the plasma sheath is calculated for the base of the cathode using the derived or assumed values for J(avg) and $V_d$ above, according to the following equation:

$$L_2=[24(10^{-2})V_d^2/5.9(10^9)J(avg)^4(\text{cm}). \quad (3)$$

The desired peak current $I_p$ is related by the average current density J(avg) to the emission area of the grooved cathode, such that the inner and outer diameters ID and OD of the cathode groove can be calculated as follows:

$$(ID+OD)=I_p/J(avg)(\text{pi})D, \quad (4)$$

where D is the groove depth as calculated in equation (2).

Once the maximum sheath width $L_s$ is known, the diameters for the groove can be calculated as:

$$ID=[(I_p/J(avg)(\text{pi})D)-40L_s]/2, \text{ and}$$

$$OD=ID+40L_s.$$

The design procedure for the single-groove cathode structure is summarized in Appendix A hereto. Once the cathode geometry has been defined by the requirements of the device in the conduction phase of the switching cycle, as given above, checks can be made to ensure that the cathode is capable of meeting the demands of the triggering and commutation phases. The design procedure given above will result in a single-groove cathode that is able to operate at a desired peak current, rate of rise of current, duty cycle, trigger voltage, and tube drop.

For a hydrogen thyratron having the single-groove cathode geometry of FIG. 2A, and choosing a grid drive of 500 Volts, a maximum average current density of the cathode of 150 Amps/cm$^2$ can be obtained for a groove depth of D=1.27 cm and a wall spacing of S =0.32 cm. The ratio of depth to wall spacing D/S is 4.0. The propagation rate of plasma along the cathode surface as a function of grid voltage is about 31.25 cm/usec, and the time to cover the entire cathode with the plasma front is about 40 nsec. Since during commutation and conduction the cathode is operating at a maximum average current of 150 Amps/cm$^2$, or a peak current of 750 Amps, and the cathode will reach the desired peak current value in a time of 40 nsec, the rate of rise of current for the single-groove cathode of the given dimensions is about 19 KAmps/usec.

The grooved tungsten impregnated cathode has the advantageous characteristic that ions accelerated by the potential drop across the tube in all phases of the switching cycle move parallel to the cathode emitting surfaces. It is probable that only a fraction of the ions strike the emission surfaces during normal tube operation. The opposing walls of the grooved emission surfaces allow for any barium that is stripped from the cathode due to ion bombardment to be scattered to the other surfaces in the groove, thereby resulting in no loss of emission material. A second advantage of the grooved cathode is in its thermal properties. Tungsten dispenser cathodes suffer from long warm-up times due to the mass of the cathode. The radiation losses from the grooved cathode are much less than that of a simple cylindrical cathode. The grooved structure effectively thermally isolates the emission surfaces, resulting in decreased warm-up times and a corresponding decrease in heater power required.

Comparative tests were conducted on large-groove and small-groove versions of the single-groove tungsten impregnated cathode. The cathodes used in these tests were impregnated tungsten cathodes. The cathodes were manufactured by SpectraMat, and were Type-B, 80% porous, tungsten cathodes. All cathodes were processed simultaneously to assure manufacturing consistency and thereby eliminate process and material variations. Each cathode was built with a potted heater so that variations in cathode performance due to hot spots could be reduced. The cathodes were operated at a temperature of 1050 degrees Centigrade for all tests. Three cathodes were built and tested for each of three individual cathode designs, resulting in a total of nine test cathodes.

All cathodes were tested in the ITT-8264 hydrogen diode of ITT Electron Technology Division, Easton, Pa., wherein the conventional oxide-coated cathode was replaced with the grooved cathode under test. The hydrogen diode was used to simulate the grid to cathode spacing of a thyratron. Use of a diode, as opposed to a thyratron, allowed elimination of many variables without impacting cathode performance. The 8264 is a glass envelope diode which allowed for the measurement of cathode temperature with an optical pyrometer. A ceramic envelope device would have required to use of a thermocouple placed on the cathode surface which could have adverse effects on cathode performance. The cathodes were tested in a circuit capable of operating at a frequency of 60 Hz with a maximum tube anode voltage of 20 KV. The test current pulse width was 3 usec, and the circuit limited rise time of the current was 0.840 usec.

The baseline data used for comparison with the grooved cathode was generated utilizing a device with an emission surface perpendicular to the ion flow (similar to the one shown in FIG. 1). Three cathodes having this horizontal emission surface were tested, each having a depth of 1.27 cm to the support walls, and 2.03 cm overall, a diameter of 1.81 cm, and a horizontal surface area of 2.57 cm$^2$. Tests of the horizontal emitter cathode showed qualitative performance similar or inferior to that of the conventional oxide-coated cathode.

Figure 6B:
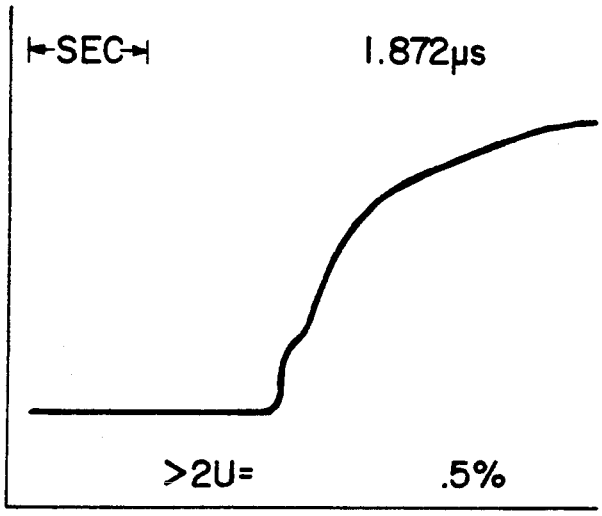
FIG. 6B is a plot of the rise time of current, for a horizontal emitter cathode used as a baseline comparison.
Figure 6A:
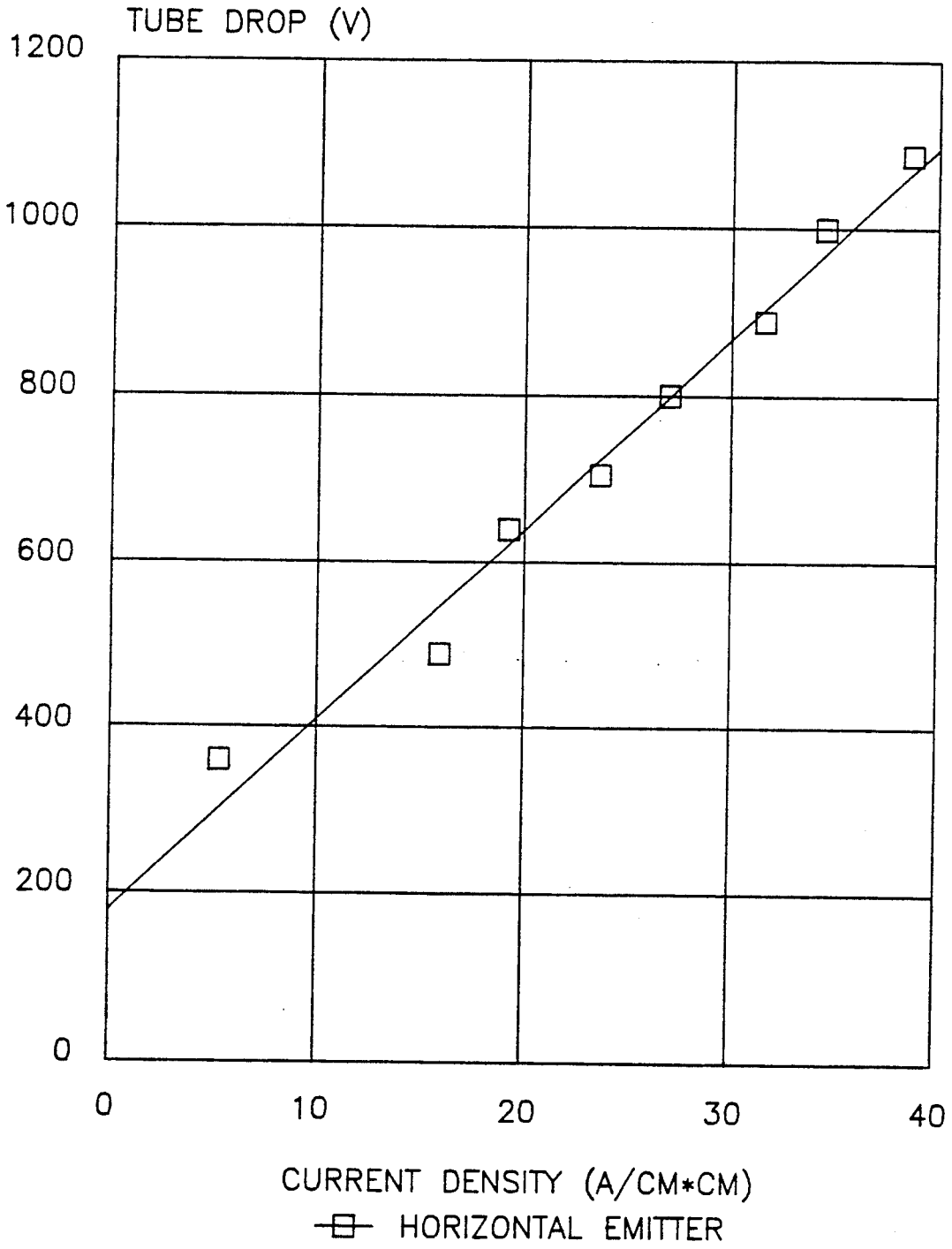
FIG. 6A is a plot of test data of current density to tube voltage drop.

The plot in FIG. 6A reveals two deficiencies of the horizontal emitter cathode: a high tube voltage drop for a given range of current density; and the upper limit of the current density. The horizontal emitter cathode exhibited a tube drop of 650V when operated at a current density of less than 20 Amp/cm$^2$, whereas an oxide-coated cathode will have a maximum potential drop of 275V when operated at a current density of 20 Amp/cm$^2$ The horizontal emitter cathode was also found to have a maximum current density of 40 Amp/cm$^2$, with a corresponding tube drop of 1.1 KV, compared to oxide-coated cathodes which are capable of operating at a peak current density of 30 Amp/cm$^2$ at low duty cycles. The maximum current density limit was indicated by a decrease in the potential drop across the device, indicating that the tube had entered an arc discharge mode.

The high tube drop and low emission density of the horizontal emitter cathode confirmed the hypothesis that the monolayer of barium on the surface of the cathode was depleted by ion bombardment. This phenomenon was further exhibited by erratic measured characteristics of the diode. Operation of the device at higher voltages resulted in decreased conduction time while the Off time remained constant, indicating that the higher voltages increased the number of ions and ion velocity such that the ions impinged on the cathode surface and wiped it clean of barium in a shorter time. In the Off state, the cathode replenished the surface with barium and the device would once again enter conduction. It was also found that decreasing the gas pressure would result in an increase in conduction time, indicating that the barium was being depleted at a lower rate.

A measurement of the rise time of the current pulse for the horizontal emitter cathode is shown in FIG. 6B. The measured rise time of 1.872 usec was well beyond the test circuit-limited rise time of 0.840 usec. Due to the depletion of barium from the cathode surface, the cathode was unable to support conduction in the commutation stage of the switch cycle. In summary, the tests of the horizontal emitter cathode demonstrated the negative effects of ion bombardment on the cathode surface.

Tests were conducted for the grooved cathode design as shown in FIG. 2A. The single-groove design offered geometric simplicity with the added benefit that the design factors could be extrapolated to multi-grooved cathodes. The vertical surfaces allowed a high area to volume ratio. For testing the influence of plasma sheath width, a large groove and a small groove design were compared. By assuming an average current density of 90 Amp/cm$^2$ (it was later found that a maximum of 150 Amp/cm$^2$ could be sustained), and a maximum allowable tube drop of $V_d$=250V, a sheath width of $L_s$=0.14 mm was calculated using equation 3 above. Further using the design factors indicated above, the large-grooved cathode (LGC) was designed with a groove width of S =3.17 mm, or about 22$L_s$. The small-grooved cathode (SGC) was designed with a groove width of S=0.8 mm, or about 6$L_s$. The two versions otherwise had the same external cylindrical dimensions as the horizontal emitter cathode.

The inner and outer diameters of the two versions were chosen so that they would both have the same emission surface area of 4.9 cm$^2$ limited to the area of the groove. Use of equal emission surface areas provided control for determining if the minimum groove width (viz. plasma sheath width ratio) was less than 6$L_s$ or greater than 22$L_s$. If the minimum groove width less than 6$L_s$ or greater than 22$L_s$, then each cathode would operate at the same maximum emission density. If the LGC exhibited higher emission capability than the SGC, then it would be known that the minimum groove width would lie between 6$L_s$ and 22$L_s$.

Figure 7B:
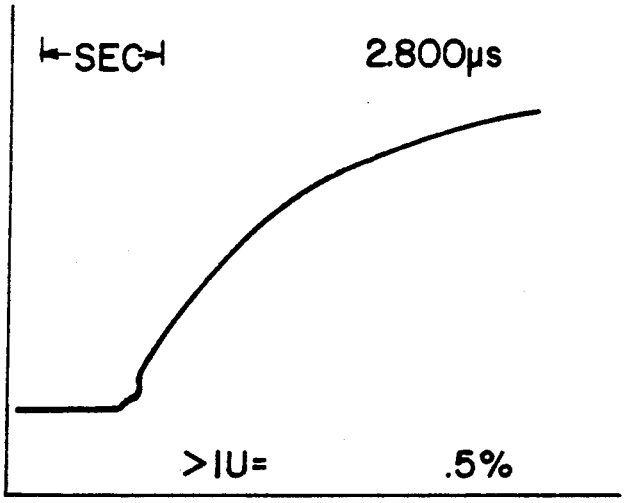
FIG. 7B is a plot of the rise time of current, for a small-grooved version of a single-groove dispenser cathode in accordance with the invention.
Figure 8B:
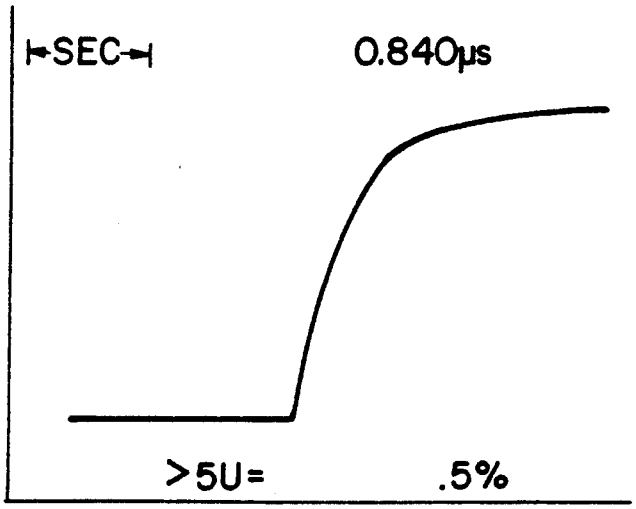
FIG. 8B is a plot of the rise time of current, for a large grooved version of a single-groove dispenser cathode in accordance with the invention.
Figure 7A:
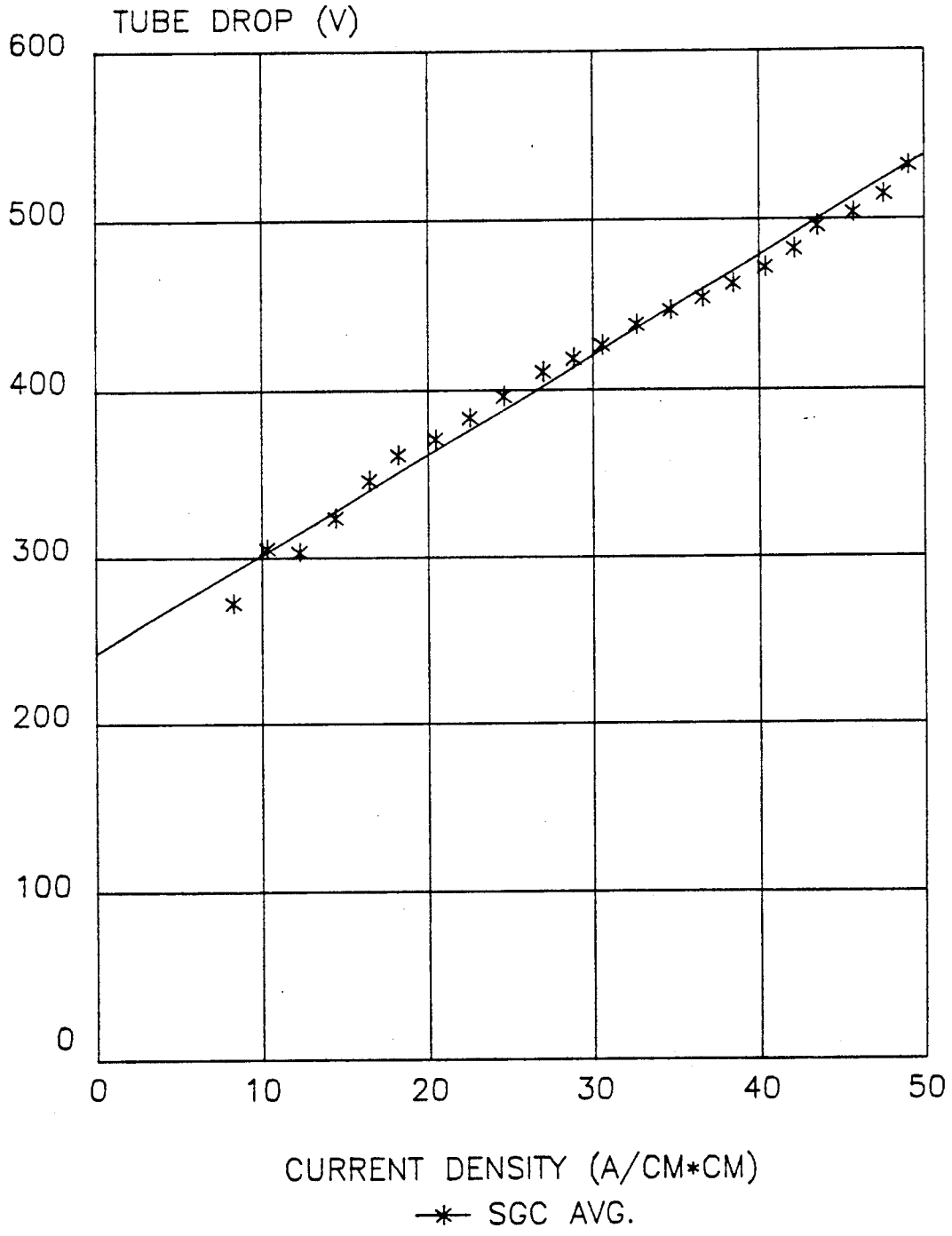
FIG. 7A is a plot of test data of current density to tube voltage
Figure 8A:
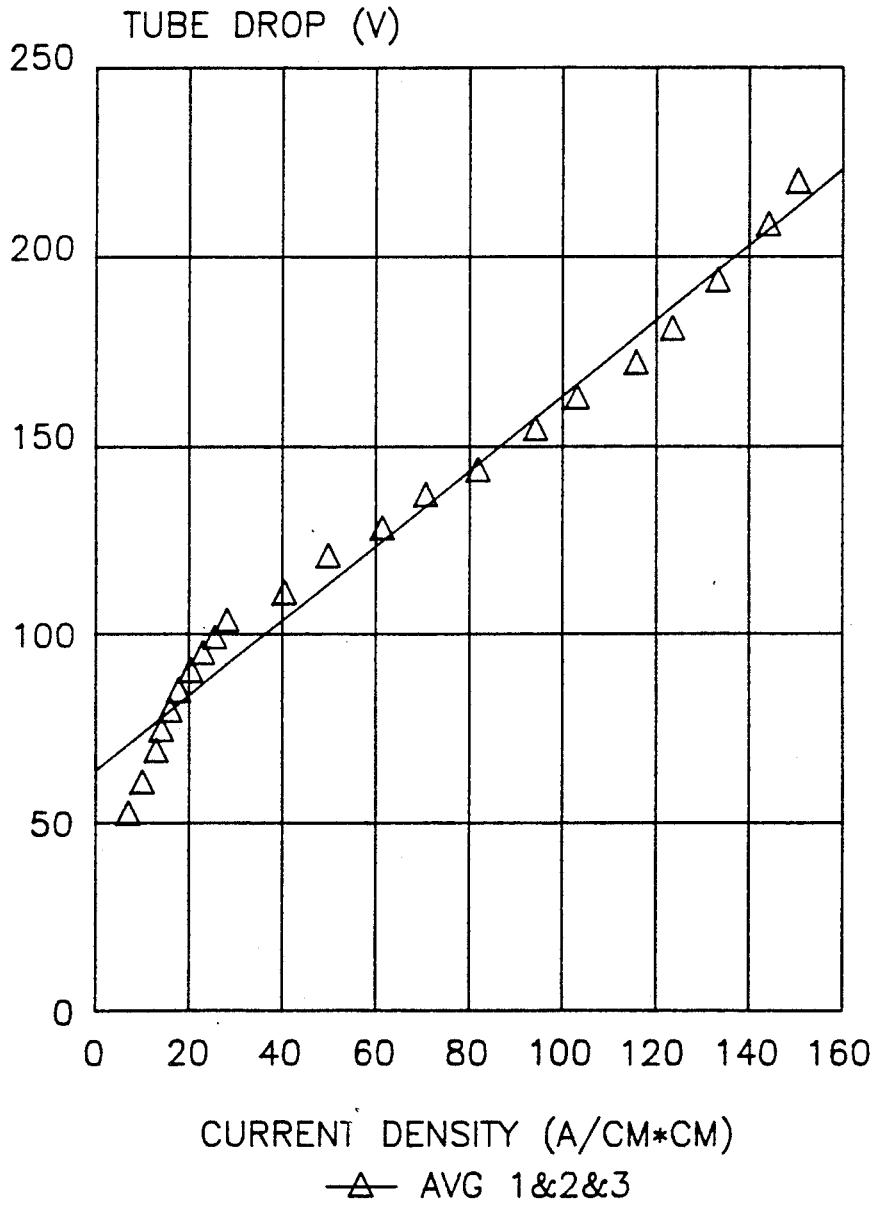
FIG. 8A is a plot of test data of current density to tube voltage drop.

Plots of the current densities vs. voltage drop for the small-grooved cathode (SGC) and the large-grooved cathode (LGC) are shown in FIGS. 7A and 8A, respectively. The current density is substantially greater and the voltage drop is less for the LGC. Therefore, the minimum groove width was shown to lie between 6$L_s$ and 22$L_s$. The average current densities were determined by dividing the peak current during conduction by the area of the cathode. The maximum current densities, which were determined by the transition from glow discharge mode to arc discharge mode, was about 50 Amp/cm$^2$ for the SGC, compared to about 150 Amp/cm$^2$ for the LGC. As compared to the horizontal emitter surface, the LGC maximum current density was about four to five times greater, and the tube drop was four to five times less.

Further evidence that the plasma in the groove trough of the SGC is unable to ionize to the extent of the LGC is shown in the comparison of rise times of the current pulse of the two grooved cathode versions in FIGS. 7B and 8B, respectively. The rise time of the SGC in the test circuit was 2.3 usec, which is about three times the circuit-limited rise time. The rise time of the LGC was measured at the circuit-limited value of 0.840 usec, thus indicating that the entire cathode surface was being utilized.

The data from these tests indicated that there is a preferred minimum groove width. As explained above, it is found that a minimum groove width of 20$L_s$ should be used to ensure proper operation of the cathode. Given the average current density and the maximum allowable tube drop, the plasma sheath width $L_s$ is calculated (per equation 3) and the minimum groove width can be determined as at least 20$L_s$.

In order to determine the optimum groove depth D, as given in equation 2 above, a value for the plasma conductivity must be known. The plasma conductivity can be represented as:

$$s=L_s/RA, \tag{7}$$

where $L_s$ is the calculated value for plasma sheath width, and RA represents the product of the plasma sheath resistance and the area of the plasma sheath. It can be assumed that the area of the plasma sheath is equal to the area of the cathode groove since the plasma sheath covers the cathode emission surface with a sheath thickness of only a fraction of a millimeter. The value R is the resistive drop in the plasma sheath. The value of RA can be determined from the slope of the tube drop versus average current density, which was RA=0.833 ohm-cm$^2$ for the large-grooved cathode represented by FIG. 8A. Test have confirmed this derivation for the value RA, thereby allowing computation of the plasma conductivity.

The conventional oxide-coated cathode used in the ITT8264 hydrogen diode has a cathode surface area of 37 cm$^2$, which is about eight times the area of 4.9 cm$^2$ for the large-grooved cathode (LGC). The rate of rise of current for the oxide-coated cathode was measured and found to be maximum of 4.3 KA/us, as compared to a cathode limited di/dt of 18 KA/us for the LGC. If the area of the LGC were increased by adding concentric grooves to make the total area equal to that of the oxide-coated cathode, a rate of rise of current of the order of 234 KA/us could be expected. The average current density of the oxide-coated cathode is about 30 Amp/cm$^2$, as compared to 150 Amp/cm$^2$ for the LGC. For the oxide-coated cathode the rated peak anode voltage is 16 KV, the rated peak current is 300 A, and therefore the peak switching power is 4.8 MW. By comparison, if the area of the LGC were made equal to that of the oxide-coated cathode, a peak current of 6000 A and a cathode-limited peak switching power of 960 MW could be expected. The act switching power limit of the grooved dispenser cathode device is therefore not emissionlimited, but rather limited by physical factors.

It is therefore possible to realize an increase in rate of rise of current of at least five and up to 55 times, an increase in average current density of five times, and an increase of peak switching power of up to 200 times, when an oxide-coated cathode is replaced by a grooved impregnated tungsten cathode of equal area. Tests were also run to compare the expected lifetimes of the two types of cathodes. The oxide-coated cathode was operated at a peak current of 300 A or a current density of 8.1 Amp/cm$^2$, and was found to fail after 650 hours. In contrast, the LGC was operated at a peak current of 400 A or a current density of 82 Amp/cm$^2$, and was found to still be fully operative after 2500 hours. Although the upper limit of lifetime for the LGC was beyond the scope of the tests, it can be seen that the LGC remained operable for a substantially longer time than a conventional oxide-coated cathode operated at onetenth the current density.

The specific embodiments of the invention described herein are intended to be illustrative only, and many other variations and modifications may be made thereto in accordance with the principles of the invention. All such embodiments and variations and modifications thereof are considered to be within the scope of the invention, as defined in the following claims.

APPENDIX A
GROOVED CATHODE DESIGN PROCEDURE

1. Given duty cycle determine J(avg) from FIG. 5A
2. Calculate tube drop as;
   $V_d = 100 + .833(J(avg))$ (V)
3. Determine average plasma sheath width from $V_d$ and J(avg) as; $L_s = [24(10^{-2})V_d^2/5.9(10^9)J(avg)]^{\frac{1}{3}}$(cm)
4. Calculate conductivity as;
   $s = L_s/0.833(1/\Omega\ cm)$
5. DEFINE $J_o$ as (.85)J(avg)
6. Calculate groove depth as;
   $D = 2(J(avg) - J_o)/s(2.5 \times 10^3)$(cm)
7. Determine ID and OD as;
   $ID = [(I_p/J(avg)\pi D) - 40\ L_s]/2$
   $OD = ID + 40\ L_s$

We claim:

1. In a gas-filled electron-emitting device having a dispenser cathode fabricated from a porous refractory metal interspersed with an electron emitting material, said cathode when in operation having an electron emitting surface that is subjected to ion bombardment by ionized gas plasma along a given direction of ion flow which can undesirably deplete said electron emitting material from said electron emitting surface, the improvement wherein said cathode is formed with a front surface thereof perpendicular to the direction of ion flow and at least one groove in said front surface having opposing walls parallel to the direction flow, whereby the bombarding ions which impinge on one wall can cause emitting material depleted therefrom to be deposited on the opposite wall, and a minimal net loss of emitting material occurs, said walls having a given depth D and being separated from each other by a given spacing S, wherein said groove wall spacing S is at least 20 times the width $L_s$ of a plasma sheath which becomes interposed in said groove for a given maximum average current density J(avg) and a given voltage drop $V_d$ across the device, wherein $L_s$ is:

$$L_s=[24(10^{-2})V_d^2/5.9(10^9)J(avg)]^{\frac{1}{3}}(\text{cm}).$$

2. An improved device according to claim 1, wherein the voltage drop $V_d$ is:

$$V_d=V_s+RA_sJ(avg),$$

where $V_s$ is the sustaining voltage of typically 100 Volts, and the product of $RA_s$ is a constant equal to 0.833 ohms-cm$^2$.

3. An improved device according to claim 1, wherein the maximum average current density J(avg) is obtained for a selected duty cycle according to a characteristic of average current density versus duty cycle similar to that for a Type-B dispenser cathode.

4. An improved device according to claim 1, wherein the depth D of said groove is:

$$D=2(J(avg)-J_o)/s(dE/dZ),$$

where $J_o$ is the value of current density at the bottom of the cathode depth taken to be in the range of between 75% and 95% of J(avg), and preferably about 85% of J(avg), s is the average value of the conductivity of the plasma sheath, and dE/dZ is the rate of change of field intensity with respect to distance Z, taken to be a constant value of about 2.5 KV/cm$^2$.

5. An improved device according to claim 4, wherein said cathode is formed as a right cylinder and said groove is a single annular groove in the front surface of said right cylinder having an inner diameter ID and an outer diameter OD, and wherein for a desired peak current $I_p$ the inner and outer diameters ID and OD are:

$$(ID+OD)=I_p/J(avg)(\text{pi})D, \text{ and}$$

$$OD=ID+40L_s \text{ (minimum groove spacing).}$$

6. An improved device according to claim 1, wherein J(avg) and $V_d$ are selected such that the peak average current density of said device is in the range of 150 Amps/cm$^2$.

7. An improved device according to claim 1, wherein said gas-filled device is a hydrogen thyratron having an anode, grid, and said grooved cathode in spaced relationship for high power switching performance.

8. An improved thyratron according to claim 7, wherein said cathode is formed as a right cylinder and said groove is a single annular groove in the front surface of said right cylinder having a depth D=1.27 cm, a spacing S=3.2 mm, and a surface area of about 4.9 cm$^2$.

9. An improved thyratron according to claim 8, wherein said grid has a drive voltage in the range of 500 Volts, and said cathode provides a maximum current density in the range of 150 Amp/cm$^2$, provides a peak current in the range of 750 Amps, reaches the peak current value in a time in the range of 40 nsec, and has a rate of rise of current in the range of 18 KAmps/usec.

10. An improved thyratron according to claim 7, wherein said cathode is formed as a right cylinder and said groove is formed as a plurality of concentric annular grooves in the front surface of said right cylinder.

11. An improved thyratron according to claim 9, wherein said grid has a drive voltage in the range of 500 Volts, and said cathode has a total surface area in the range of 37 cm$^2$, provides a peak current of up to 6000 Amps, has a rate of rise of current of up to 234 KAmps/usec, and has a cathode-limited peak switching power of up to 960 MW.

12. A method of using a dispenser cathode in a gas-filled electron-emitting device, wherein the dispenser cathode is fabricated from a porous refractory metal interspersed with an electron emitting material, said cathode when in operation having an electron emitting surface that is subjected to ion bombardment by ionized gas plasma along a given direction of ion flow which can undesirably deplete said electron emitting material from said electron emitting surface, comprising the steps of:

forming said cathode with a front surface thereof perpendicular to the direction of ion flow and at least one groove in said front surface having opposing walls parallel to the direction flow, whereby the bombarding ions which impinge on one wall can cause emitting material depleted therefrom to deposited on the opposite wall, and a minimal net loss of emitting material occurs.

13. A method of using a dispenser cathode in a gas-filled electron-emitting device according to claim 12, wherein said forming step includes forming said walls to have a given depth D and separated from each other by a given spacing S, wherein said groove wall spacing S is at least 20 times the width $L_s$ of a plasma sheath which becomes interposed in said groove for a given maximum average current density J(avg) and a given voltage drop Vd across the device, wherein $L_s$ is:

$$L_s=[24(10^{-2})V_d^2/5.9(10^9)J(avg)]^{\frac{1}{3}} \text{ (cm)}.$$

14. A method of using a dispenser cathode in a gas-filled electron-emitting device according to claim 13, wherein the voltage drop $V_d$ is:

$$V_d=V_s+RA_sJ(avg),$$

where $V_s$ is the sustatining voltage of typically 100 Volts, and the product of $RA_s$ is a constant equal to 0.833 ohms-cm$^2$.

15. A method of using a dispenser cathode in a gas-filled electron-emitting device according to claim 13, wherein the maximum average current density J(avg) is obtained for a selected duty cycle according to a characteristic of average current density versus duty cycle similar to that for a Type-B dispenser cathode.

16. A method of using a dispenser cathode in a gas-filled electron-emitting device according to claim 13, wherein the depth D of said groove is:

$$D=2(J(avg)-J_o)/s(dE/dZ),$$

where $J_o$ is the value of current density at the bottom of the cathode depth taken to be in the range of between 75% and 95% of J(avg), and preferably about 85% of J(avg), s is the average value of the conductivity of the plasma sheath, and dE/dZ is the rate of change of field intensity with respect to distance Z, taken to be a constant value of about 2.5 KV/cm$^2$.

17. A method of using a dispenser cathode in a gas-filled electron-emitting device according to claim 16, wherein said cathode is formed as a right cylinder and said groove is a single annular groove in the front surface of said right cylinder having an inner diameter ID and an outer diameter OD, and wherein for a desired peak current $I_p$ the inner and outer diameters ID and OD are:

$$(ID+OD)=I_p/J(avg)(\text{pi})D, \text{ and}$$

$$OD=ID+40L_s \text{ (minimum groove spacing)}.$$

18. A method of using a dispenser cathode in a gas-filled electron-emitting device according to claim 12, wherein said gas-filled device is a hydrogen thyratron having an anode, grid, and said grooved cathode in spaced relationship for high power switching performance.

19. An improved device according to claim 1, wherein said cathode is made from an 80% density porous tungsten matrix structure impregnated with emitting material composed in the mole ratio of 5BaO:3-CaO:2$Al_2O_3$.

20. A method of using a dispenser cathode in a gas-filled electron-emitting device according to claim 12, wherein said cathode is made from an 80% density porous tungsten matrix structure-impregnated, with emitting material composed in the mole ratio of 5BaO:3-CaO:2$Al_2O_3$.

* * * * *